US005697396A

United States Patent [19]

Kamitani

[11] Patent Number: 5,697,396

[45] Date of Patent: Dec. 16, 1997

[54] AIR FEED VALVE AND EXHAUST VALVE TO BE ATTACHED TO AN UNDERWATER SUIT

[76] Inventor: Shigeki Kamitani, 8-1-933. Nakahara 1-shome. Isogo-ku, Yokohama-shi. Kanagawa-ken. 235, Japan

[21] Appl. No.: 548,319

[22] Filed: Nov. 1, 1995

[30] Foreign Application Priority Data

Nov. 1, 1994 [JP] Japan ..... 6-292241

[51] Int. Cl.[6] ..... A62B 17/00

[52] U.S. Cl. ..... 137/81.2; 2/2.15

[58] Field of Search ..... 2/2.15, 2.16, 2.17; 137/81.2

[56] References Cited

U.S. PATENT DOCUMENTS 3,568,209 3/1971 O'Neill et al. ..... 2/2.17

3,720,208 3/1973 Aldrich et al. ..... 2/2.15

4,229,832 10/1980 Dickson, Jr. ..... 137/81.2

4,674,429 6/1987 Buckle et al. ..... 137/81.2

*Primary Examiner*—A. Michael Chambers

*Attorney, Agent, or Firm*—Cushman Darby & Cushman IP Group of Pillsbury Madison & Sutro LLP

[57] ABSTRACT

Disclosed is an improved air feed valve to be attached to an underwater suit, responsive to a water pressure P measured at a selected point A of the underwater suit for permitting air to flow to the inside of the underwater suit at a predetermined flow rate from an associated compressed air cylinder via its primary pressure-reduction valve and tube, thereby keeping the inner air pressure of the underwater suit at a given value. The air feed valve is set for operation so as to feed air at such a flow rate that the inner air pressure of the underwater suit may be kept at a pressure lower than the pressure $P-_{\Delta}P$ measured at a position A–X which is closer by a given distance X to the water surface than the selected point A of the underwater suit.

1 Claim, 5 Drawing Sheets

AIR FEED VALVE AND EXHAUST VALVE TO BE ATTACHED TO AN UNDERWATER SUIT

BACKGROUND OF THE INVENTION

1. Field of the Invention

The present invention relates to an air feed valve and an exhaust valve to be attached to an underwater suit for controlling the inner pressure of the underwater suit.

2. Prior Arts

Underwater suits are used widely in scuba diving. Such underwater suits have air feed and exhaust valves attached for controlling their inner air pressures in water.

More specifically, the air feed valve is designed to be responsive to a water pressure at a selected point of the underwater suit in water for permitting air to flow to the inside of the underwater suit at a predetermined flow rate from an associated compressed air cylinder via its primary pressure-reduction valve and flexible tube, thereby keeping the inner air pressure of the underwater suit at a given value.

The air feed valve is attached to the part of the underwater suit fitting the abdomen, and is designed to control the air flow rate so as to keep the inner pressure of the underwater suit equal to the pressure applied to the air feed valve. As a result, the inner pressure of the underwater suit from neck to foot is same as the water pressure applied to the abdomen.

The water pressure applied to a scuba diver in water varies everywhere in his underwater suit. Assume that the scuba diver floats upside down in water. Then, his head is at a level which is deeper than his abdomen, and therefore the water pressure applied to his head is higher than the water pressure applied to his abdomen. On the other hand, his feet is at a level which is shallower than his abdomen, and therefore the water pressure applied to his feet is lower than his abdomen.

Thus, the inner pressure of the underwater suit, which is equal to the water pressure applied to his abdomen, is lower than the water pressure applied to his head, and therefore, the air is liable to move toward his feet until the parts of the underwater suit fitting his feet have been inflated with air, increasing the buoyance of the parts fitting his feet. As a consequence the scuba diver has difficulty in moving in water.

In short, the underwater suit has an air feed valve attached to the part fitting the abdomen for putting the inner pressure of the underwater suit at the same pressure as applied to his abdomen, and therefore, the air is permitted to move toward the parts of the underwater suit to which decreased water pressure is applied. Specifically, the parts of the underwater suit which are closer to the water surface are liable to be inflated with air, accordingly increasing the buoyance of the air-inflated parts of the underwater suit, and this has the effect of decreasing the mobility of the scuba diver in water.

SUMMARY OF THE INVENTION

One object of the present invention is to provide an air feed valve to be attached to an underwater suit, which valve assures that the underwater suit is free of partial inflations when the scuba diver is in water.

Another object of the present invention is to provide an air exhaust valve to be attached to an underwater suit, which valve assures that the underwater suit has air spreading in equilibrium condition when the scuba diver is in water.

To attain these objects an air feed valve to be attached to an underwater suit, responsive to a water pressure P measured at a selected point A of the underwater suit for permitting air to flow to the inside of the underwater suit at a predetermined flow rate from an associated compressed air cylinder via its primary pressure-reduction valve and tube, thereby keeping the inner air pressure of the underwater suit at a given value, is improved according to the present invention in that it is set for operation so as to feed air at such a flow rate that the inner air pressure of the underwater suit may be kept at a pressure lower than the pressure $P-_{\Delta}P$ measured at a position A–X which is closer by a given distance X to the water surface than the selected point A of the underwater suit.

The air feed valve is connected to flexible tubes extending to the parts of the underwater suit each fitting a leg and an arm, said tubes having a plurality of air-ejecting holes to communicate with their inner channels.

An air exhaust valve to be attached to an underwater suit, responsive to a water pressure Q measured at a selected point of the underwater suit for permitting air to flow to the outside of the underwater suit at a predetermined flow rate, thereby keeping the inner air pressure of the underwater suit at a given value, is improved according to the present invention in that it is set for operation so as to exhaust the air at such a flow rate that the inner air pressure of the underwater suit may be kept at a pressure higher than the pressure $Q+\Delta Q$ measured at a position B+Y which is closer by a given distance Y to the seabed than the selected point B of the underwater suit.

Other objects and advantages of the present invention will be understood from the following description of an air feed valve and an air exhaust valve according to the present invention, which are shown in accompanying drawings.

DETAILED DESCRIPTION OF PREFERRED EMBODIMENTS

Figure 1:
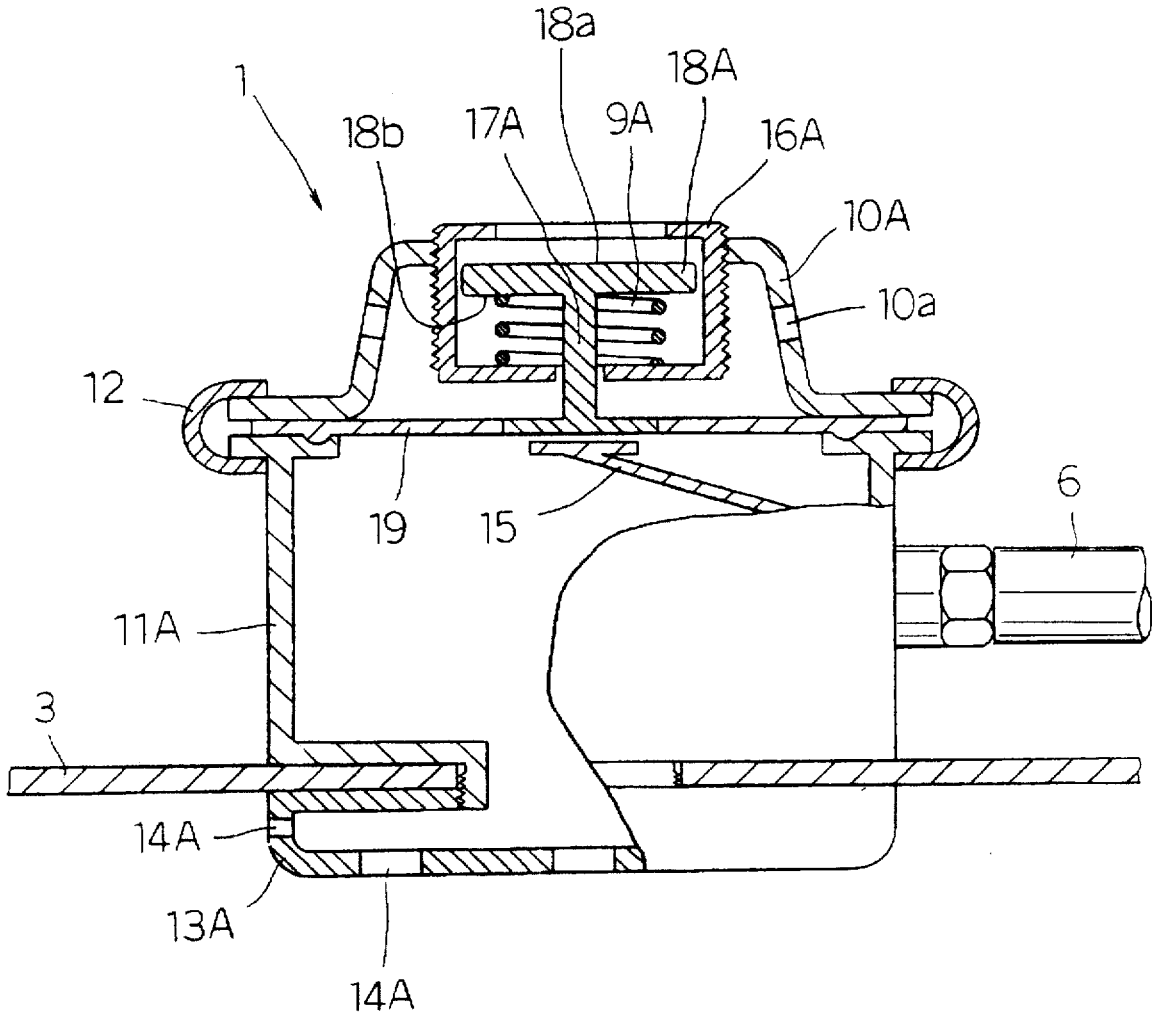
FIG. 1 is a sectional view of an air feed valve according to a preferred embodiment of the present invention.
Figure 2:
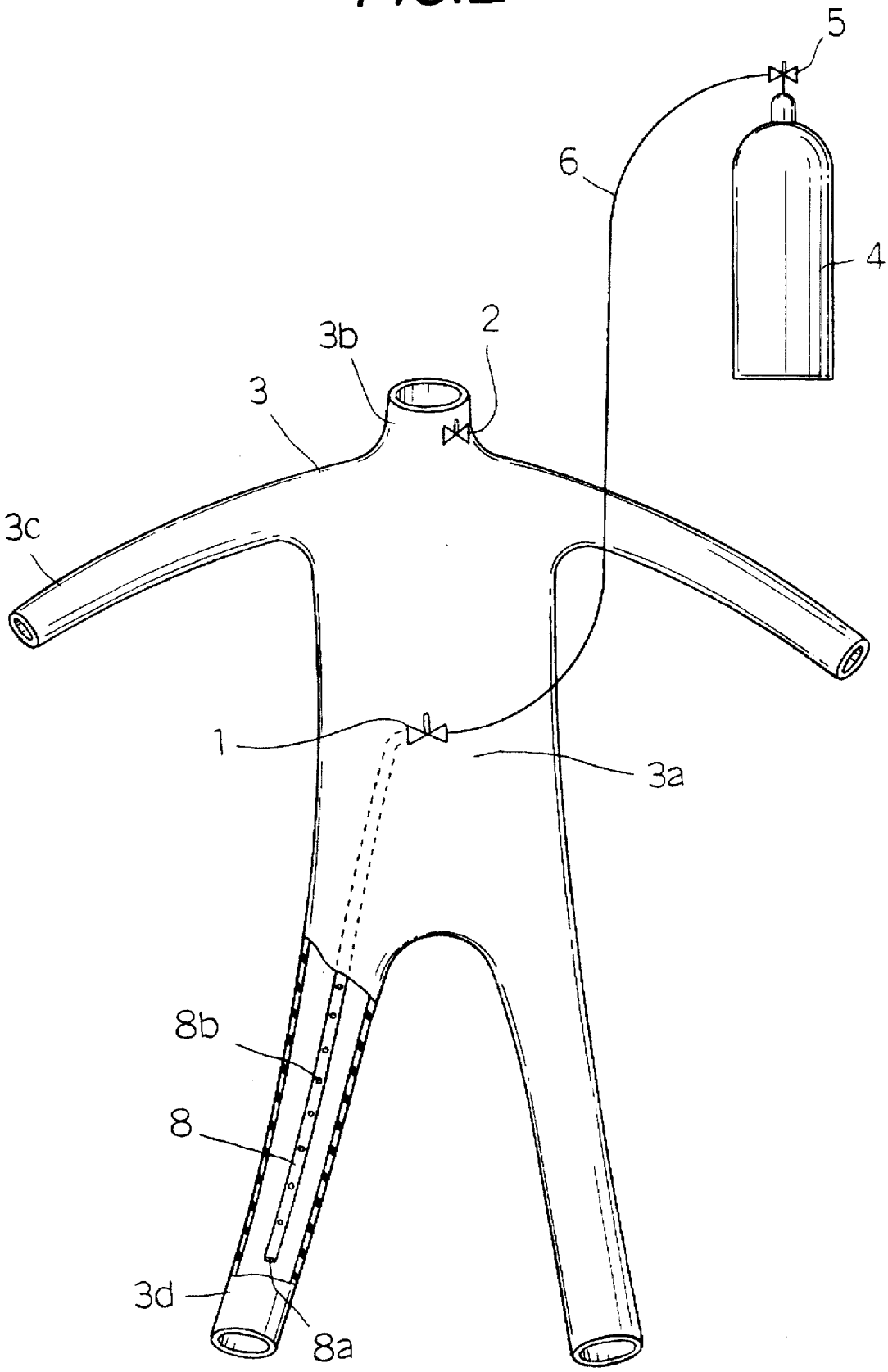
FIG. 2 shows an underwater suit having the air feed valve and air exhaust valve attached thereto.
Figure 3:
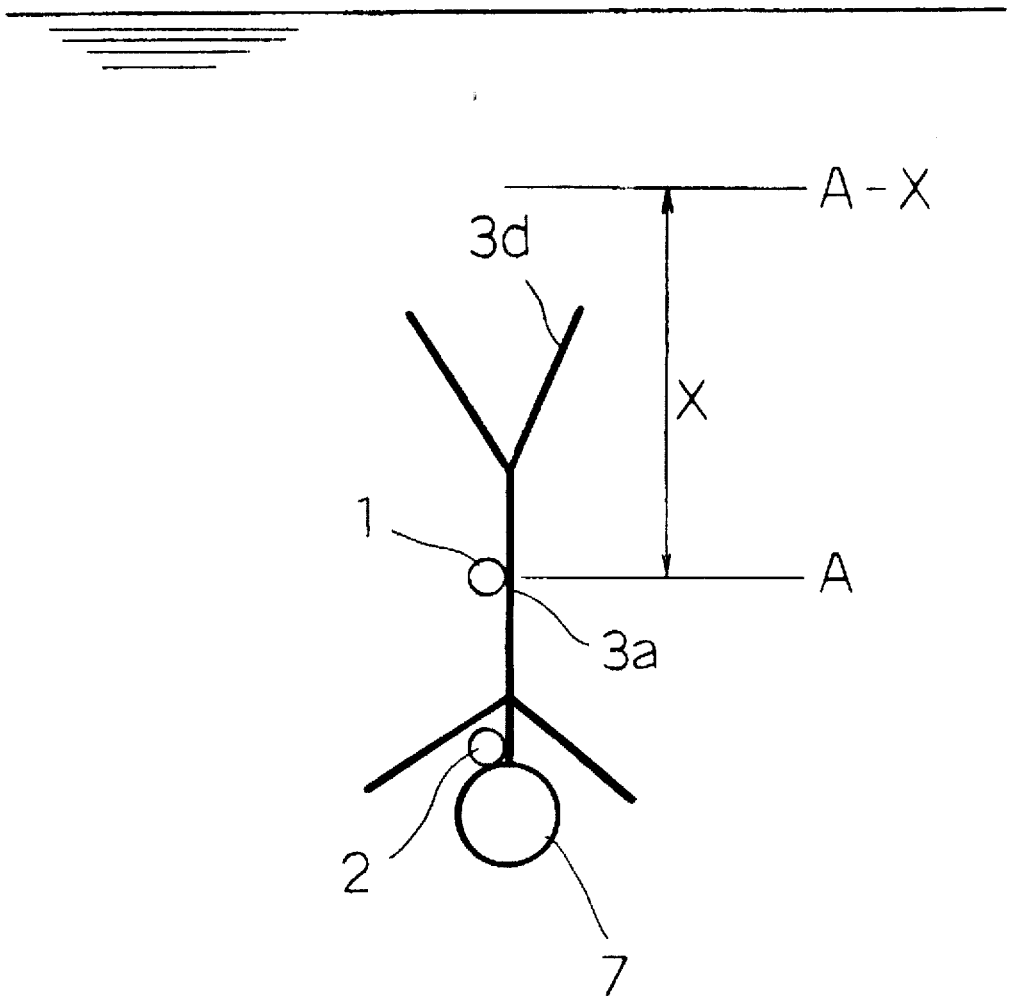
FIG. 3 shows diagramatically a scuba diver wearing an underwater suit having the air feed valve and air exhaust valve attached thereto, floating upside down.

Referring to FIGS. 1 to 3, particularly FIG. 2, an air feed valve 1 according to the present invention is attached to an underwater suit 3 to feed air to the inside of the underwater suit 3 from an associated compressed air cylinder 4 via its primary pressure-reduction valve 5 and flexible tube 6. As shown in FIG. 1, the air feed valve 1 includes a main housing part 11A and an associated sub-housing part 13A. The main housing part 11A has a coupler for detachably connecting to the flexible tube 6 extending from the compressed air cylinder 4. The sub-housing part 13A can be threadedly engaged with the main housing part 11A, and the sub-housing part 13A has a plurality of air feeding holes 14A. The main housing part 11A has a control lever 15 for permitting air to flow in the housing 11A and 13A at a controlled flow rate. The main housing part 11A has a water pressure sensing unit fixed to its top opening by fastening means 12. In the water pressure sensing unit a cover 10A has a tapped aperture in its ceiling and a plurality of water inlet holes 10*a* in its circumference; a diaphragm 19 is stretched across the bottom opening of the cover 10A; a resilient force adjuster cylinder 16A has relatively large and small openings on its top and bottom, and threads on its circumference to mate with the tapped inner-circumference of the ceiling aperture of the cover 10A; and a water pressure-sensitive part 17A is resiliently connected between the resilient force adjuster cylinder 16A and the diaphragm 19. Specifically, the water pressure-sensitive part 17A comprises top and bottom flanges and a stem integrally connected to these disks. Its top flange 18A is put in the resilient force adjuster cylinder 16A, and is pushed upward by a spring 9A. The bottom flange of the water pressure-sensitive part 17A is connected to the diaphragm 19 to face the control lever 15. The water pressure-sensitive part 17A can be controlled in pressure-sensitivity by turning the resilient force adjuster cylinder 16A so that it may be responsive to a desired water pressure for lowering and actuating the control lever 15, which permits air to flow at a controlled flow rate depending on the descending amount of the control lever 15. As shown, the air feed valve 1 is attached to the underwater suit 3 by sandwiching a part of the underwater suit 3 fitting the abdomen, thus permitting air to flow into the underwater suit 3 when the water pressure-sensitive part 17A detects the water pressure set for operation.

The air feed valve 1 is set for opening by turning the resilient force adjuster cylinder 16A so that air may be fed at such a flow rate that the inner air pressure of the underwater suit 3 may be kept at a pressure lower than the pressure $P-_{\Delta}P$ measured at a position A–X which is closer by a given distance X to the water surface than the selected point A of the underwater suit 3, where A stands for the level at which the air feed valve is in water, and P stands for the water pressure measured at the part fitting the abdomen, to which part the air feed valve is attached.

As seen from FIG. 2, the underwater suit 3 has flexible tubes 8 extending from the air feed valve 1 to the parts each fitting a leg and an arm. The tubes 8 has a plurality of air-ejecting holes 8*b* to communicate with their inner channels 8*a*.

Referring to FIG. 3, assume that an air feed valve 1 is attached to the part of the underwater wear 3 fitting the abdomen 3*a*, and that a scuba diver is floating upside down in water. The water feed valve 1 detects the water pressure P at the selected point A of the underwater suit 3, and then it feeds air into the underwater suit 3 at such a flow rate that the inside of the underwater suit 3 may be kept at a pressure lower than the pressure of $P-_{\Delta}P$ measured at a position A–X which is closer by a given distance X to the water surface than the selected point A of the underwater suit 3.

As a consequence, the underwater suit 3 is shrunk on his body, and it should be noted that the parts fitting his legs are shrunk equally, thereby leaving no space to permit invasion of air from the other part of the underwater suit 3, thus preventing inflation of the parts fitting his legs with air.

When the air is injected into the underwater suit 3 through the flexible tubes 8, it spreads towards the remote parts fitting the hands 3*c* and the feet 3*d*.

Figure 5:
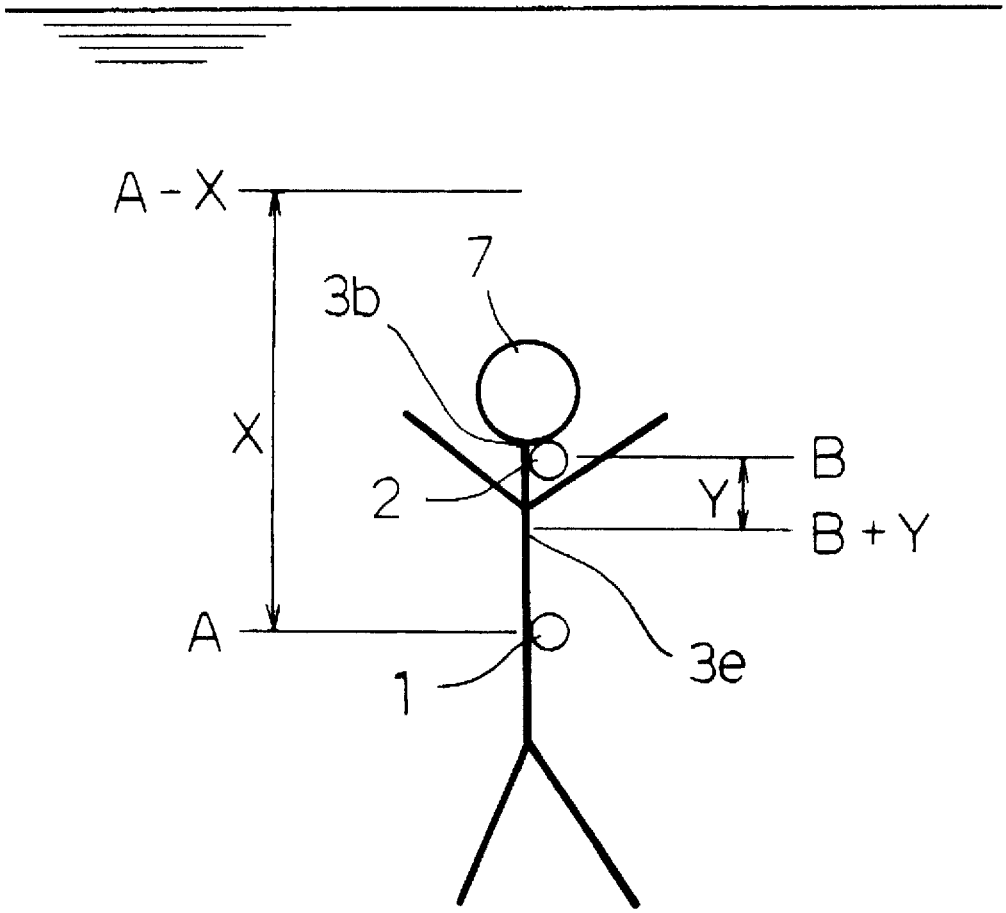
FIG. 5 is similar to FIG. 3, but showing diagramatically the scuba diver floating upright in water.

The air feed valve 1 works similarly when the scuba diver is floating upright as shown in FIG. 5. The part fitting his neck 3*b* is compressed, thereby preventing invasion of air from the other part of the underwater suit 3, thus preventing the part fitting his neck 3*b* to be inflated with air.

Figure 4:
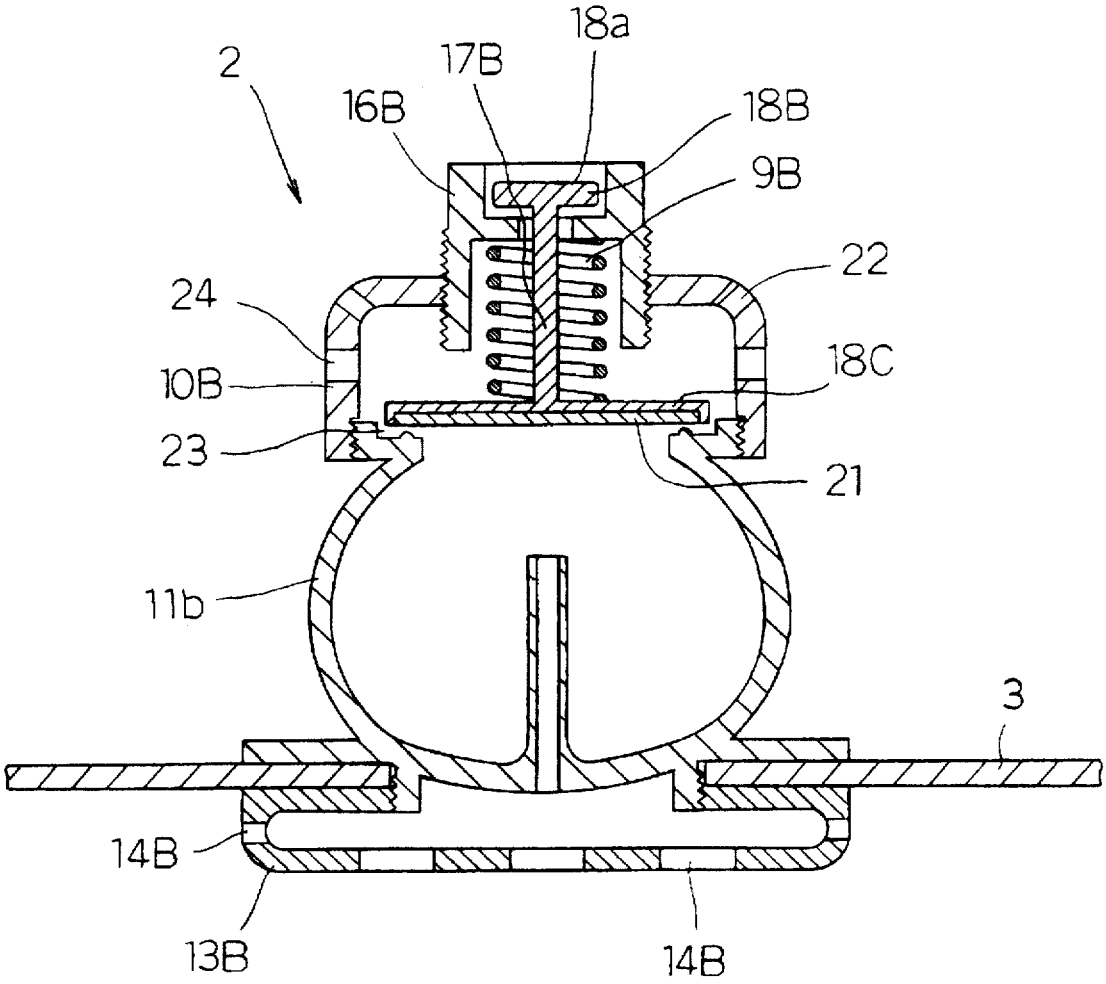
FIG. 4 is a sectional view of an air exhaust valve according to a preferred embodiment of the present invention.

Now, referring to FIGS. 4 and 5, an air exhaust valve 2 is attached to the part of the underwater suit 3 fitting a scuba diver's neck for permitting air to flow to the outside of the underwater suit 3 at a predetermined flow rate. As shown in FIG. 4, the air exhaust valve 2 includes a main housing part 11B and an associated sub-housing part 13B.

The sub-housing part 13B can be threadedly engaged with the main housing part 11B, and it has a plurality of air feeding holes 14B. The main housing part 11A has a water pressure sensing unit fixed to its top opening. In the water pressure sensing unit a cover 10B has a tapped aperture in its ceiling and a plurality of air-outlet holes 24 in its circumference; a resilient force adjuster cylinder 16B has threads on its circumference to mate with the tapped inner-circumference of the ceiling aperture of the cover 10B; and a water pressure-sensitive part 17B is resiliently connected to the cylinder 16B. Specifically, the water pressure-sensitive part 17B comprises top and bottom flanges and a stem integrally connected to these flanges 18B and 18C. The lower flange 18C has a sealing membrane 21 attached to its lower surface. The lower flange 18C of the water pressure-sensitive part 17B is pushed downward by a spring 9B to close the inner space of the main housing part 11B in air-tight way. The water pressure-sensitive part 17B can be controlled in pressure-sensitivity by turning the resilient force adjuster cylinder 16B so that it may be responsive to a desired inner pressure for rising, thereby permitting the air to flow at a controlled flow rate depending on the rising amount of the lower flange 18C. As shown in FIG. 4, the air exhaust valve 2 is attached to the underwater suit 3 by sandwiching a selected part of the underwater suit 3 fitting the neck, thus permitting air to flow out of the underwater suit 3 when the water pressure-sensitive part 17B detects the air pressure set for operation.

The air exhaust valve 2 is set for opening by turning the resilient force adjuster cylinder 16B so that air may be exhausted at such a flow rate that the inner air pressure of the underwater suit 3 may be kept at a pressure higher than the pressure $Q+\Delta Q$ measured at a position B+Y which is closer by a given distance Y to the seabed than the selected point B of the underwater suit 3.

Referring to FIG. 5, assume that an air exhaust valve 2 is attached to the part of the underwater wear 3 fitting the neck 3*b*, and that a scuba diver is floating upright in water. The water exhaust valve 2 detects the water pressure Q at the selected point B of the underwater suit 3, and then the air is exhausted at such a flow rate that the inner air pressure of the underwater suit 3 may be kept at a pressure higher than the pressure $Q+\Delta Q$ measured at a position B+Y which is closer by a given distance Y to the seabed than the selected point B of the underwater suit 3.

As a consequence, the part of the underwater suit 3 below the position B+Y is shrunk on his body under increased pressure, and it should be noted that the part fitting his neck is inflated with air appropriately, thereby putting the air in an equilibrium condition in which air spreads evenly in the underwater suit 3, preventing excessive inflation of the part fitting his neck with air.

As may be understood from the above, the air feed valve prevents the excessive inflation of the part of the underwater suit closer to the water surface with air, thereby assuring that the scuba diver can move freely in water. The air exhaust valve permits the part of the underwater suit closer to the water surface to be put in an equilibrium condition.

What is claimed is:

1. A diving arrangement comprising:

a dry suit for donning by a diver, said dry suit including a body portion, a neck portion extending from said body portion, at least one arm portion extending from said body portion, and at least one leg portion extending from said body portion;

an air feed valve for supplying air into a space defined between a diver body and said dry suit; and flexible tubes, extending to said portions of said dry suit, having a plurality of holes and connected to said air feed valve;

wherein said air feed valve is connected to a compressed air supply via a primary pressure-reduction valve and a tube;

wherein said air feed valve supplies air at a predetermined flow rate into said space depending upon a water pressure detected at said air feed valve while said diver is under the water, an air exhaust valve being provided on said dry suit for discharging air from said space so that the air within said space can be exhausted when the air pressure within said space becomes higher than a water pressure detected at said air exhaust valve;

wherein said air feed valve is mounted on the body portion of said dry suit;

wherein a water pressure at a sensing point A of said air feed valve at the body portion is P;

wherein a water pressure at an upper point A–X, closer to a water surface than said sensing point A by the distance X, is P-ΔP; and wherein said air feed valve is mounted on the body portion and irrespective of the diving position of the diver, said air feed valve regulates the feeding of air from said air feed valve into said space such that the air pressure within said space is balanced with said water pressure P, and allows air to be fed in an amount sufficient to maintain an air pressure lower than the water pressure of P-ΔP, such that at least one of said portions of said dry suit is uniformly compressed by the water pressure, irrespective of diving position, to thus prevent air flow into and inflation of a first portion of the dry suit by the flow of air from another portion of the dry suit into the first portion of the dry suit.

* * * * *